US005579915A

United States Patent [19]

Liss

[11] Patent Number: 5,579,915

[45] **Date of Patent: *Dec. 3, 1996**

[54] CONTAINER FOR PLASTIC BAGS

[75] Inventor: Olle G. Liss, Upsala, Sweden

[73] Assignee: Produktutvecklingsföretaget NI AB, Upsala, Sweden

[ * ] Notice: The term of this patent shall not extend beyond the expiration date of Pat. No. 5,386,910.

[21] Appl. No.: 385,158

[22] Filed: Feb. 7, 1995

Related U.S. Application Data

[63] Continuation of Ser. No. 30,282, Mar. 26, 1993, Pat. No. 5,386,910.

[51] Int. Cl.[6] ..... B65D 85/16

[52] U.S. Cl. ..... 206/554; 220/676; 220/908; 221/309; 229/927

[58] Field of Search ..... 206/554, 494; 221/303, 307, 309; 232/1 C, 1 E; 229/927; 220/676, 908, 910

[56] References Cited

U.S. PATENT DOCUMENTS 2,155,191 4/1939 Hylton et al. .

2,212,129 8/1940 Rust .

3,549,226 12/1970 Samson .

*Primary Examiner*—David T. Fidei

*Attorney, Agent, or Firm*—Jeffrey Slusher

[57] ABSTRACT

A container for storing bags for re-use includes a substantially flat rear wall that extends in a lengthwise direction and can be mounted on a supporting surface by, for example, adhesive tape or screws. A pair of opposing side wall portions are joined with the rear wall, extend in the lengthwise direction, and have inward extending, opposing inner edges opposite the rear wall. A bottom portion is joined to the rear wall and to each of the side walls. The rear wall, the side walls, and the bottom portion define between them a convex interior of the container. Bags can be inserted into the interior of container through a top opening. A slit that is at least as wide as a predetermined minimum user wrist width extends lengthwise between the inner edges of the side walls over substantially the entire length of the container and into the interior of the container. Arbitrary ones of the bags are thereby reachable and removable from the container by a hand of the user regardless of the position of other bags in the container. The side walls preferably diverge upward from the bottom portion so that one container can be stacked within another.

2 Claims, 4 Drawing Sheets

CONTAINER FOR PLASTIC BAGS

CROSS REFERENCE TO RELATED APPLICATIONS

This application is a continuation of U.S. patent application Ser. No. 08/030,282, filed Mar. 26, 1993 now U.S. Pat. No. 5,386,910.

BACKGROUND OF THE INVENTION

1. Field of the Invention

This invention relates to a container that allows for simple storage and re-use of plastic bags.

2. Description of Related Art

Plastic bags are often re-used for reasons of both economy and the environment. It is therefore also a common problem that the bags to be re-used must be stored. Conventional options require either too much space or that the bags be folded.

One known container is a carrier bag. The problem with this solution is that it is bulky and does not allow individual bags to be easily and selectively removed. Another problem is that it is difficult to mount such a carrier bag satisfactorily. As a result many people have such carrier bags filled with other plastic bags lying around in a cupboard, which is far from optimal.

No containers are at present available that are efficient in their use of space. To reduce the space requirement, one must often fold the bags in a special manner. This is not only time consuming but, as with the carrier-bag solution, it does not allow bags to be removed selectively. For example, bags must typically be folded to keep them in a drawer without taking up too much space, but it is not easy to have the drawer near where one keeps garbage bags, which is a common use for the stored bags.

What is needed is a container for bags that eliminates these disadvantages, that is relatively cheap to produce, that has low weight, and that is easy to attach at some optimal place.

SUMMARY OF THE INVENTION

A container according to the invention for storing bags for re-use includes a substantially flat rear wall that extends in a lengthwise direction and can be mounted on a supporting surface by, for example, adhesive tape or screws. A pair of opposing side wall portions are joined with the rear wall, extend in the lengthwise direction, and have inward extending, opposing inner edges opposite the rear wall. A bottom portion is joined to the rear wall and to each of the side walls. The rear wall, the side walls, and the bottom portion define between them a convex interior of the container. Bags can be inserted into the interior of container through a top opening. A slit that is at least as wide as a predetermined minimum user wrist width extends lengthwise between the inner edges of the side walls over substantially the entire length of the container and into the interior of the container. Arbitrary ones of the bags are thereby reachable and removable from the container by a hand of the user regardless of the position of other bags in the container.

The side walls preferably diverge upward from the bottom portion, one container thereby being stackable in another.

DETAILED DESCRIPTION

Figure 1:
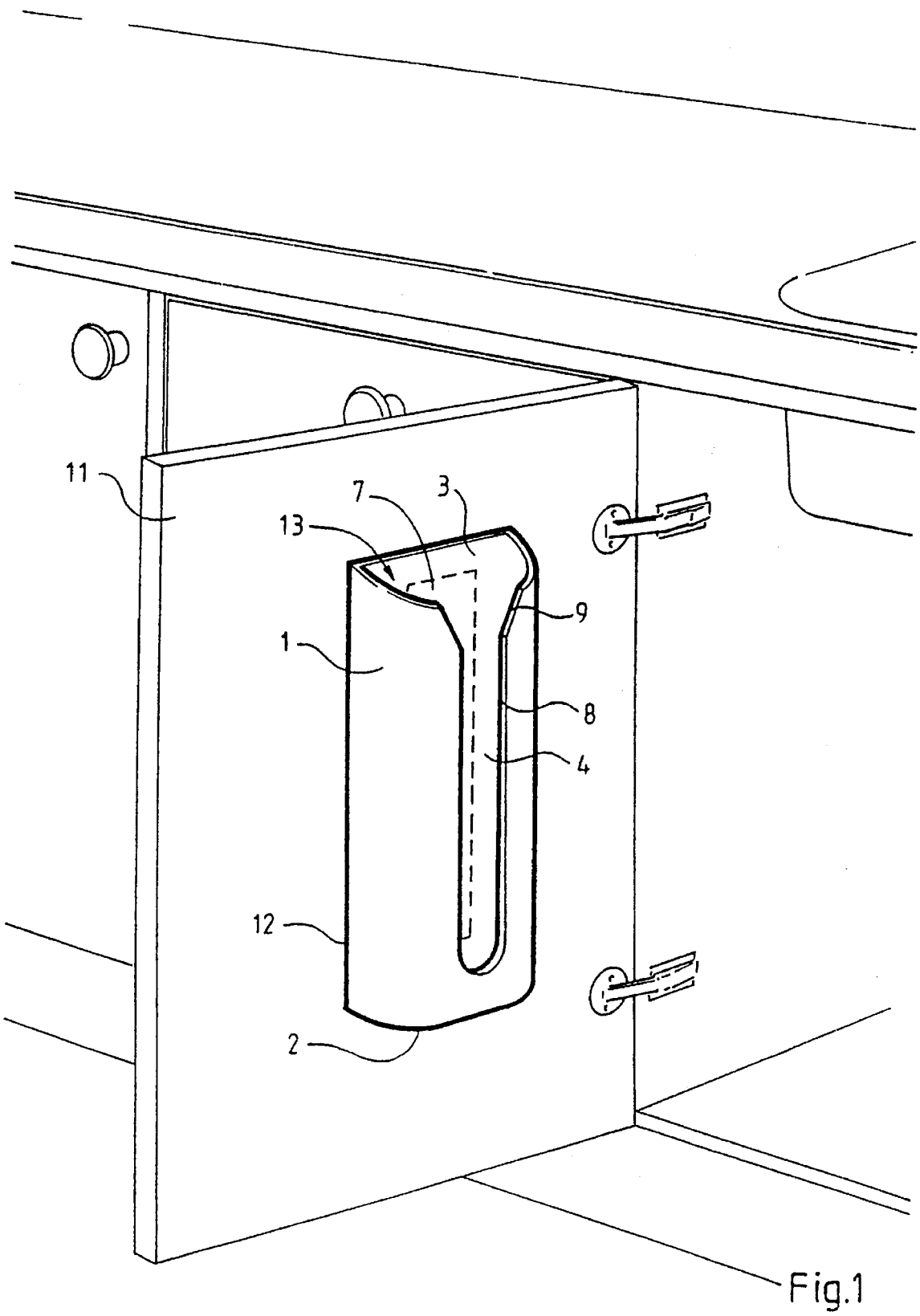
FIG. 1 shows a device according to the invention in a perspective view, attached to a door.

FIG. 1 shows a container according to the invention, which is attached to the inside of a cupboard door 11. The container consists of a bottom 2, an opening 13, a front portion 1, and a rear wall 3. The front portion 1 has opposing, curved surfaces that form front walls that are separated over most of their length by a mainly vertical, centrally positioned slit 4. The rear wall 3 has a flat surface 12 on which double-sided adhesive tape 7 can be arranged in order to attach the container to the cupboard door 11. As an alternative to the adhesive tape (see FIG. 3), protrusions 6 with holes can be provided such that screws in the door can fit through the holes to hold the container.

Parts of stuffed-away plastic bags 10, preferably their handles, extend from the slit 4. Most of the edges 8 of the slit 4 are parallel but are joined at their lower portions by means of a curved portion. The upper edges 9 of the slit 4, however, converge, so that their width is increasing relative to the lower portion of the slit. Furthermore, the container is made slightly conical so that several containers can be stacked within each other during. transport and storage.

Figure 2:
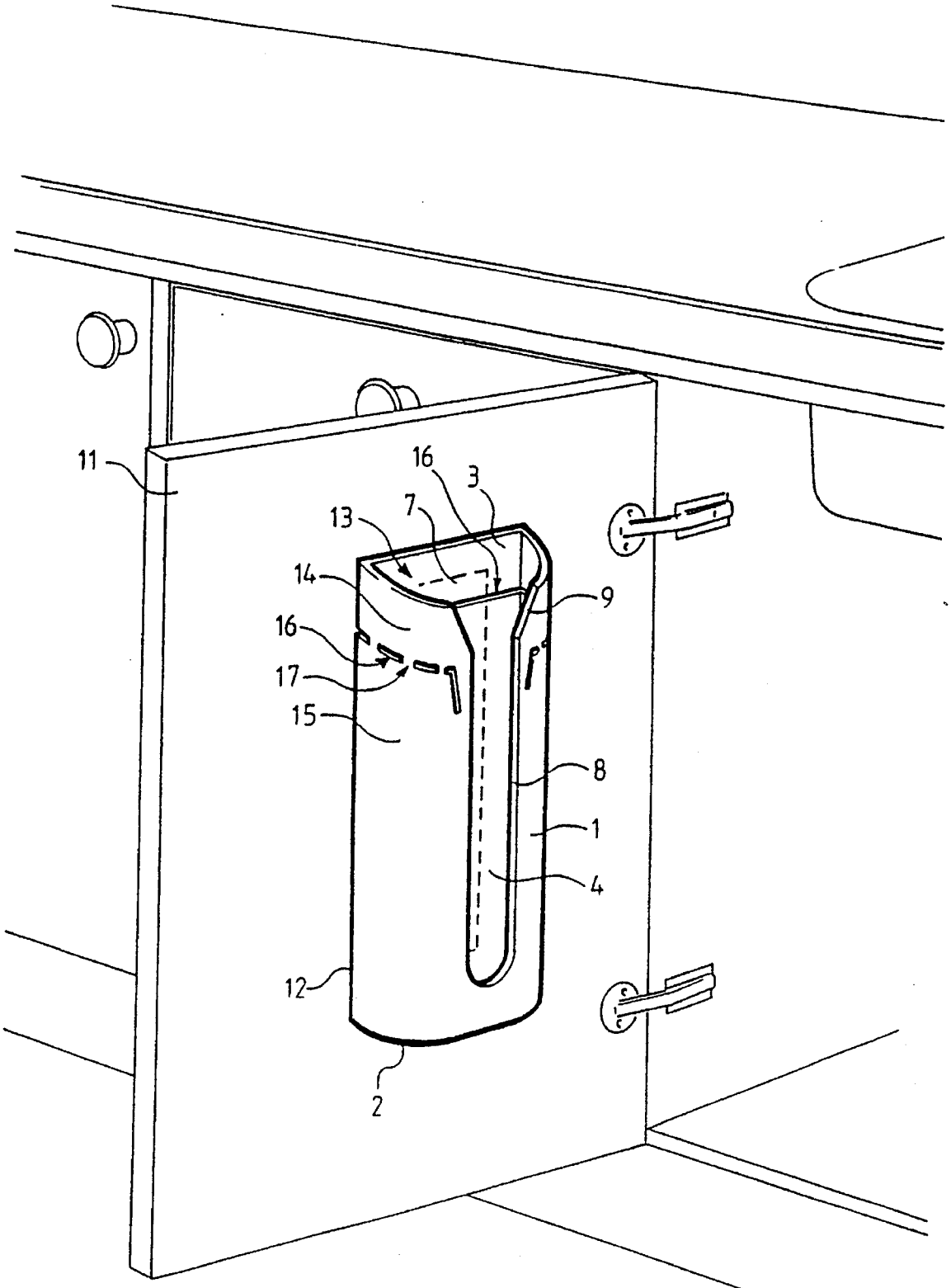
FIG. 2 shows a preferred embodiment of the invention, also attached to a door.

FIG. 2 shows a preferred embodiment of the invention, which further includes a perforation 16, 17, which is preferably made with longish openings 16 and shorter bridges 17 that divide the container into an upper portion 15 and a lower portion 15. By separating the container along the perforation in an appropriate manner, for example by cutting the bridges 17, the length of the container can be adjusted to meet the existing need, with only the lower portion 15 being mounted in the desired place for use.

Figure 3:
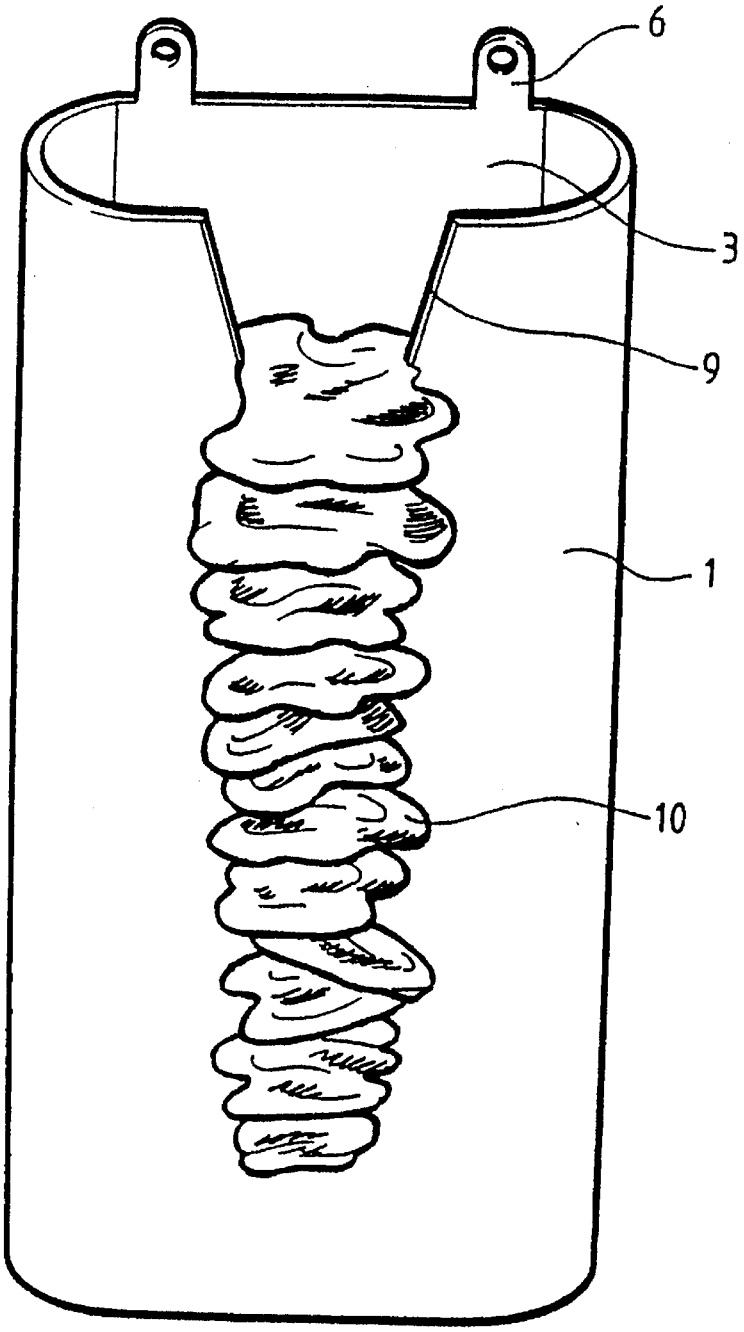
FIG. 3 shows a container according to the invention seen from the front and obliquely from above.
Figure 4:
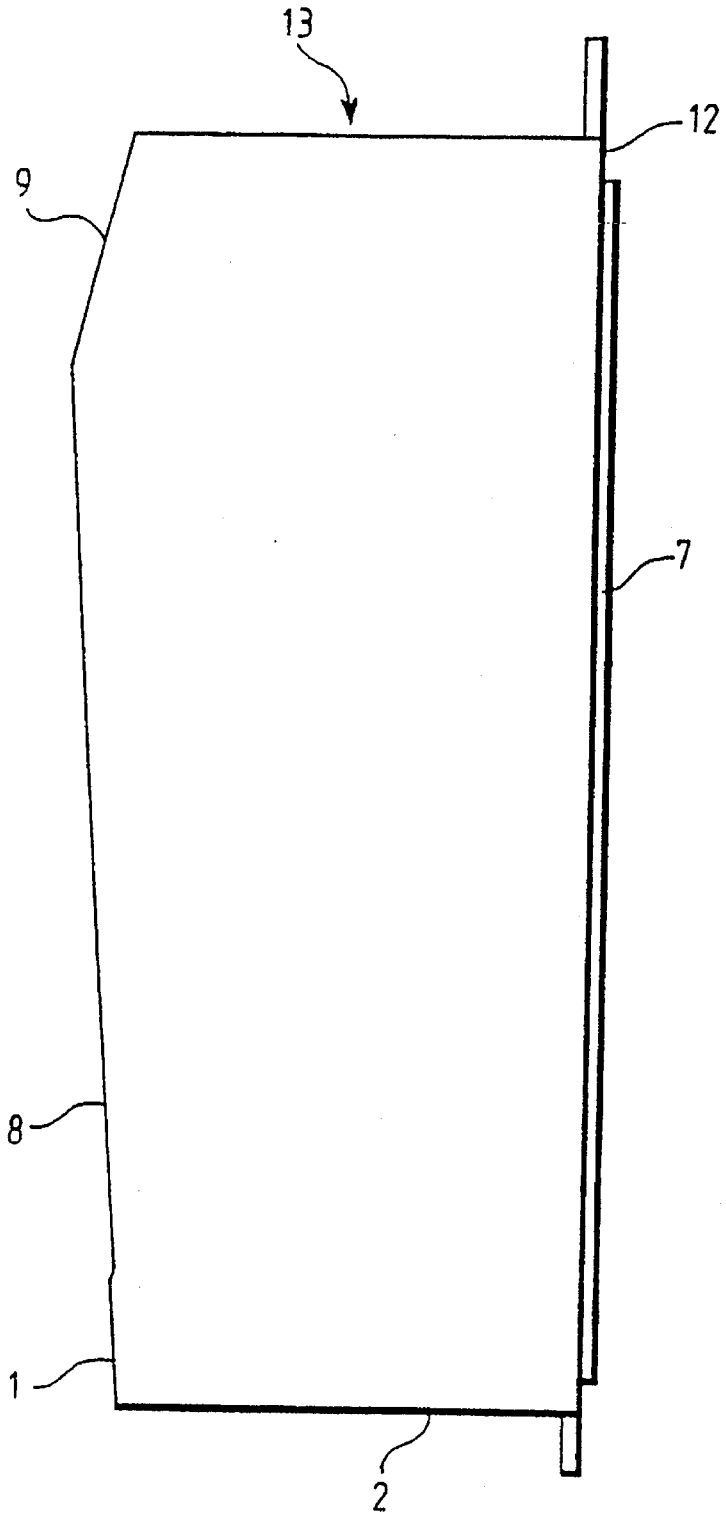
FIG. 4 is a side view of the container according to the invention.

FIG. 3 shows a container according to the invention, filled with plastic bags. A chosen part of each bag, preferably its handle, protrudes out of the slit 4. FIG. 4 shows the embodiment of FIGS. 1 and 3 from the side.

The cross sectional area of the container is adapted to the size of a hand, with appropriate consideration to the largest likely size of a user's hand. The reason for this is that, when stuffing a bag into the container, the user's hand must be able to reach down to the top of the pile of stuffed plastic bags in order to place a new bag on top of the pile. Accordingly, the cross sectional area has to be large enough to allow at least most people to be able to fit their hand into the opening of the container. On the other hand, the cross sectional area should not be too large, since this would make it impossible, at least in some cases, to secure the plastic bag in a rational manner when stuffing it in. In order to effectively fix the plastic bag in the container, it should preferably be possible to press down with the hand in the vicinity of the inner edge areas of the container. An optimum size of the container means that a person with very large hands could stuff down bags into the container with fingers curled, or in a fist, whereas a person with small hands could do the same with fingers extended. The optimal cross sectional area is therefore such that the container is approximately 14 cm wide.

The size of the cross sectional area of the container and its form are also important in order to achieve the desired fixing of the bags in the container in a compressed condition.

The discussion above also points out that another important purpose of the slit is to provide space for the user's wrist, so that the hand can be moved down between the edges of the slit into the container when stuffing in a bag. The slit therefore should be wide enough so that most people's wrists can move freely in the slit. The optimum width of the slit is therefore about 5 cm. The slit 4 does not need to extend all the way from the top to the bottom of the container but rather is preferably terminated somewhat above the bottom 2; this provides for increased stability but still allows for sufficient reach.

As is mentioned above, another function of the slit 4 is to make it possible for a part of the plastic bag, for example, its handle, to protrude for the container. It is thereby possible to selectively pick a particular bag from the pile, regardless of where in the pile the desired bag is.

To stuff a bag in the container, one preferably grips substantially the whole bag with one hand and then uses for example the fingers of the other hand to grip a smaller portion of the bag, such the handle portion of a common carrier bag. One then presses the bag into the container opening downward from the top, and continues pressing it down with one's wrist in the slit 4 until the bag reaches the top of the existing pile of plastic bags 10. One then fixes the plastic bag in place by compressing it; the bag's own elasticity then holds it in place by the force it exerts on the inner side surfaces of the container, in combination with frictional resistance.

When one wishes to take any particular bag out of the container, this can be done selectively thanks to the slit 4: One grabs the protruding part of the desired bag and pulls it straight out horizontally through the slit. Thanks to the curved outer wall portions and the appropriately rounded edges 8, this can be done without any damage to the bag. Of course, it is also possible to take the top-most bag out by first pulling it out of the container opening through the top.

As is mentioned above, double-sided adhesive tape 7 is preferred for mounting the container. This is because most plastic bags are re-used for collecting garbage, and it is normal to have one's garbage container in a bench or countertop cupboard, very often on the inside of one of its doors. In order to keep the bags handily close by, they are very often stored in the very same cupboard. The doors of these cupboards, however, are often of a relatively poor quality, so that attachment by means of screws is not always secure. Double-sided adhesive tape eliminates this concern, and it is further a very easily implemented way to mount the container. In order to eliminate the risk of improper attachment due to uneven surfaces, there is preferably a flexible intermediate layer between the two adhesive surfaces. In the preferred embodiment, however, the container also has a way for mounting using screws (see FIG. 3).

The container is preferably made by molding in materials such as polyethylene or acrylic plastic. One advantage of acrylic plastic is that the container can be made transparent, so that it is easier to find and choose the plastic bag one wants. The preferred embodiment of the invention has the following dimensions: height 45 cm; rear wall width 12 cm; slit width 5 cm; radius of curvature of the front edges 7.5 cm; and thickness of material 1.3 mm.

It is possible to form the container without the slit 4, as the container will then still hold bags, but it will then not be possible to selectively remove bags, and the maximum height of the container will be limited for natural reasons. Furthermore, although it is preferred that the slit be wider at its upper portion than below, this is not necessary. The slit may, moreover, run all the way to the bottom of the container. It is of course also possible to provide the container with more than one perforation 16, 17.

I claim:

1. A container for storing bags for re-use comprising:

a substantially flat rear wall that extends in a lengthwise direction;

mounting means for attaching the rear wall to a supporting surface;

a single pair of opposing side walls that are joined with the rear wall, extend in the lengthwise direction, and have inward extending, opposing inner edges opposite the rear wall;

a bottom wall joined to the rear wall and to each of the side walls;

the rear wall, the side walls, and the bottom wall comprising portions of a single, moldable unit and defining between them an interior of the container that is convex, closed at the bottom, and open at the top;

a top opening through which bags can be inserted into the interior of the container, the top opening having a cross sectional area greater than a predetermined minimum user hand size and less than a predetermined maximum hand size; and a slit that is at least as wide as a predetermined minimum user wrist width but less than a predetermined maximum user wrist width, that extends lengthwise between the inner edges of the side walls over substantially the entire length of the container and into the interior of the container, and through which arbitrary ones of the bags are reachable and removable from the container by a hand of the user regardless of the position of other bags in the container.

2. A container as defined in claim 1, in which the side walls diverge upward from the bottom portion, one container thereby being stackable in another.

* * * * *